US006372119B1

(12) United States Patent
Ray et al.

(10) Patent No.: US 6,372,119 B1
(45) Date of Patent: Apr. 16, 2002

(54) INERT ANODE CONTAINING OXIDES OF NICKEL IRON AND COBALT USEFUL FOR THE ELECTROLYTIC PRODUCTION OF METALS

(75) Inventors: Siba P. Ray, Murrysville; Xinghua Liu, Monroeville; Douglas A. Weirauch, Jr., Murrysville, all of PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/542,320

(22) Filed: Apr. 4, 2000

Related U.S. Application Data

(63) Continuation-in-part of application No. 09/431,756, filed on Nov. 1, 1999, now Pat. No. 6,217,739, and a continuation-in-part of application No. 09/428,004, filed on Oct. 27, 1999, now Pat. No. 6,162,334, which is a continuation-in-part of application No. 09/241,518, filed on Feb. 1, 1999, now Pat. No. 6,126,799, which is a continuation-in-part of application No. 08/883,061, filed on Jun. 26, 1997, now Pat. No. 5,865,980.

(51) Int. Cl.[7] ..... C25C 3/08

(52) U.S. Cl. ..... 205/387; 205/385; 205/386; 204/243.1; 204/247.3; 204/291; 204/292; 501/126; 502/101; 502/325; 502/326; 502/337; 502/338

(58) Field of Search ..... 501/126; 502/101, 502/325, 326, 337, 338; 204/243.1, 247.3, 291, 292; 205/385, 386, 387

(56) References Cited

U.S. PATENT DOCUMENTS

| | | | |
|---|---|---|---|
| 3,996,117 | A | 12/1976 | Graham et al. |
| 4,190,516 | A | 2/1980 | Kajimaya et al. |
| 4,288,302 | A | 9/1981 | De Nora et al. |
| 4,290,859 | A | 9/1981 | Oda et al. |
| 4,320,321 | A | 3/1982 | De Nora et al. |
| 4,374,050 | A | 2/1983 | Ray |
| 4,374,761 | A | 2/1983 | Ray |
| 4,397,729 | A | 8/1983 | Duruz et al. |
| 4,399,008 | A | 8/1983 | Ray |
| 4,455,211 | A | 6/1984 | Ray et al. |
| 4,472,258 | A | 9/1984 | Secrist et al. |
| 4,552,630 | A | 11/1985 | Wheeler et al. |
| 4,582,585 | A | 4/1986 | Ray |
| 4,584,172 | A | 4/1986 | Ray |
| 4,620,905 | A | 11/1986 | Tarcy et al. |
| 4,871,437 | A | 10/1989 | Marschman et al. |
| 4,871,438 | A | 10/1989 | Marschman et al. |
| 4,960,494 | A | 10/1990 | Nguyen et al. |
| 5,019,225 | A | 5/1991 | Darracq et al. |
| 5,137,867 | A | 8/1992 | Ray et al. |
| 5,254,232 | A | 10/1993 | Sadoway |
| 5,279,715 | A | 1/1994 | La Camera et al. |
| 5,284,562 | A | 2/1994 | Beck et al. |
| 5,378,325 | A | 1/1995 | Dastolfo, Jr. et al. |
| 5,626,914 | A | 5/1997 | Ritland et al. |
| 5,794,112 | A | 8/1998 | Ray et al. |
| 5,865,980 | A | 2/1999 | Ray et al. |
| 5,938,914 | A | 8/1999 | Dawless et al. |

OTHER PUBLICATIONS

Belyaev, "Electrolysis of Aluminum with Nonburning Ferrite ANodes", *Legkie Metal.*, 7(1):7–20, 1938. No month available.

Billehaug et al., "Inert Anodes for Aluminum Electrolysis in Hall–Héroult Cells (I)", *Aluminum*, pp. 146–150, 1981. No month available.

Billehaug et al., "Inert Anodes for Aluminum Electrolysis in Hall–Héroult Cells (II)", *Aluminum*, pp. 228–231, 1981. No month available.

*Primary Examiner*—Bruce F. Bell
(74) *Attorney, Agent, or Firm*—Alan G. Towner; Edward L. Levine

(57) ABSTRACT

An inert anode for the electrolytic production of metals such as aluminum is disclosed. The inert anode includes a ceramic oxide material preferably made from NiO, $Fe_2O_3$ and CoO. The inert anode composition may comprise the following mole fractions of NiO, $Fe_2O_3$ and CoO: 0.15 to 0.99 NiO; 0.0001 to 0.85 $Fe_2O_3$; and 0.0001 to 0.45 CoO. The inert anode may optionally include other oxides and/or at least one metal phase, such as Cu, Ag, Pd, Pt, Au, Rh, Ru, Ir and/or Os. The Ni—Fe—Co—O ceramic material exhibits very low solubility in Hall cell baths used to produce aluminum.

36 Claims, 4 Drawing Sheets

INERT ANODE CONTAINING OXIDES OF NICKEL IRON AND COBALT USEFUL FOR THE ELECTROLYTIC PRODUCTION OF METALS

CROSS REFERENCE TO RELATED APPLICATIONS

This application is a continuation-in-part of U.S. Ser. No. 09/431,756 filed Nov. 1, 1999, now U.S. Pat. No. 6,217,739 and a continuation-in-part of U.S. Ser. No. 09/428,004, filed Oct. 27, 1999, now U.S. Pat. No. 6,162,334, each of which is a continuation-in-part of U.S. Ser. No. 09/241,518 filed Feb. 1, 1999, now U.S. Pat. No 6,126,799 which is a continuation-in-part of U.S. Ser. No.08/883,061 filed Jun. 26, 1997, now U.S. Pat. No. 5,865,980 issued Feb. 2, 1999, each of which is incorporated herein by reference.

GOVERNMENT CONTRACT

The United States Government has certain rights in this invention pursuant to Contract No. DE-FC07-98ID 13666 awarded by the United States Department of Energy.

FIELD OF THE INVENTION

The present invention relates to the electrolytic production of metals such as aluminum. More particularly, the invention relates to electrolysis in a cell having an inert anode comprising oxides of nickel, iron and cobalt.

BACKGROUND OF THE INVENTION

The energy and cost efficiency of aluminum smelting can be significantly reduced with the use of inert, non-consumable and dimensionally stable anodes. Replacement of traditional carbon anodes with inert anodes allows a highly productive cell design to be utilized, thereby reducing capital costs. Significant environmental benefits are also possible because inert anodes produce essentially no $CO_2$ or $CF_4$ emissions. Some examples of inert anode compositions are provided in U.S. Pat. Nos. 4,374,050, 4,374,761, 4,399,008, 4,455,211, 4,582,585, 4,584,172, 4,620,905, 5,279,715, 5,794,112 and 5,865,980, assigned to the assignee of the present application. These patents are incorporated herein by reference.

A significant challenge to the commercialization of inert anode technology is the anode material. Researchers have been searching for suitable inert anode materials since the early years of the Hall-Heroult process. The anode material must satisfy a number of very difficult conditions. For example, the material must not react with or dissolve to any significant extent in the cryolite electrolyte. It must not react with oxygen or corrode in an oxygen-containing atmosphere. It should be thermally stable at temperatures of about 1,000° C. It must be relatively inexpensive and should have good mechanical strength. It must have high electrical conductivity at the smelting cell operating temperatures, e.g., about 900–1,000° C., so that the voltage drop at the anode is low.

In addition to the above-noted criteria, aluminum produced with the inert anodes should not be contaminated with constituents of the anode material to any appreciable extent. Although the use of inert anodes in aluminum electrolytic reduction cells has been proposed in the past, the use of such inert anodes has not been put into commercial practice. One reason for this lack of implementation has been the long-standing inability to produce aluminum of commercial grade purity with inert anodes. For example, impurity levels of Fe, Cu and/or Ni have been found to be unacceptably high in aluminum produced with known inert anode materials.

The present invention has been developed in view of the foregoing, and to address other deficiencies of the prior art.

SUMMARY OF THE INVENTION

The present invention provides an inert electrode including at least one ceramic phase material, which comprises oxides of nickel, iron and cobalt. The inert anode may also comprise at least one metal phase including copper and/or at least one noble metal.

An aspect of the invention is to provide an inert anode composition suitable for use in a molten salt bath. The composition comprises nickel, iron and cobalt oxide of the formula $Ni_xFe_{2y}Co_zO_{(3y+x+z)\pm\delta}$, where x is the molar amount of Ni, y is the molar amount of Fe, z is the molar amount of Co, and δ is a variable which depends upon firing conditions.

Another aspect of the invention is to provide a method of making an inert anode composition. The method includes the steps of mixing nickel oxide, iron oxide and cobalt oxide, or precursors of such oxides, followed by calcining the mixture to form a ceramic material of the formula $Ni_xFe_{2y}CO_zO_{(3y+x+z)\pm\delta}$, where x is the molar amount of Ni, y is the molar amount of Fe, z is the molar amount of Co, and δ is a variable which depends upon firing conditions.

Some other aspects of the invention are to provide an electrolytic cell and an electrolytic process for producing commercial purity aluminum, utilizing the present inert anode materials.

Additional aspects and advantages of the invention will occur to persons skilled in the art from the following detailed description.

DETAILED DESCRIPTION

Figure 1:
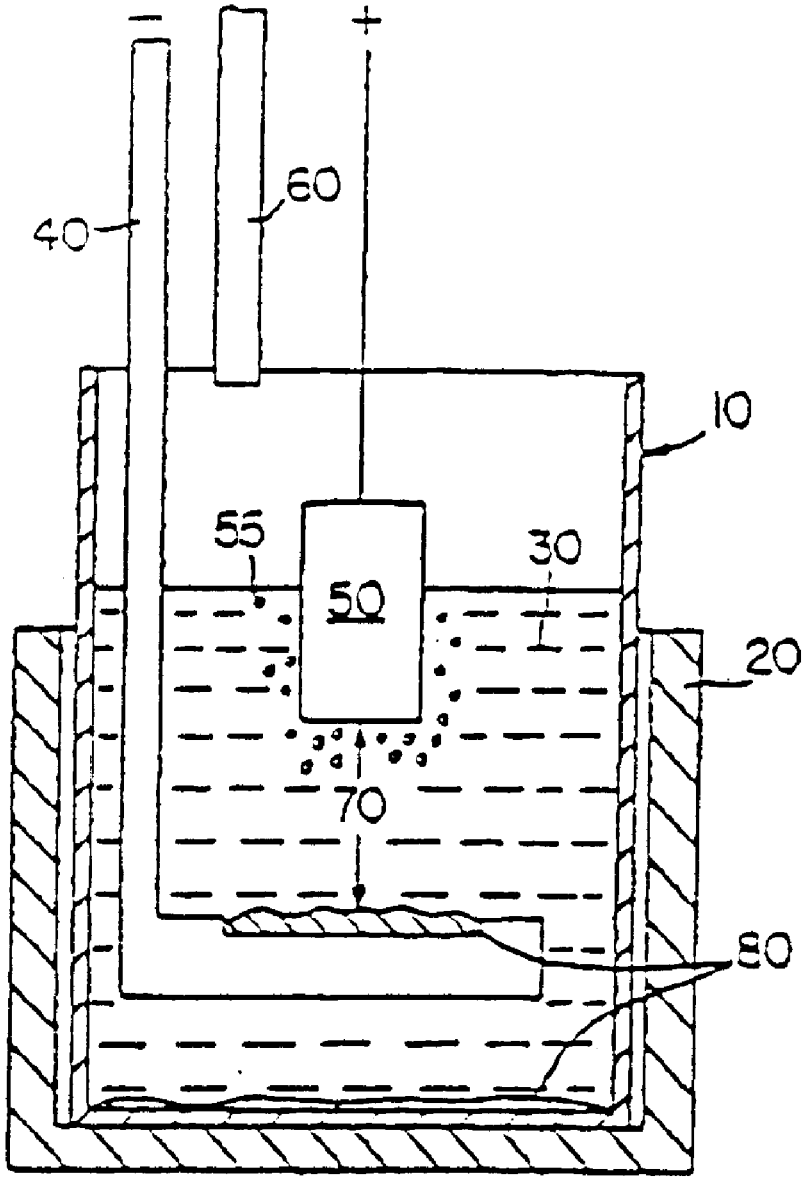
FIG. 1 is a partially schematic sectional view of an electrolytic cell for the production of aluminum including an inert anode in accordance with an embodiment of the present invention.

FIG. 1 schematically illustrates an electrolytic cell for the production of aluminum, which includes an inert anode in accordance with an embodiment of the present invention. The cell includes an inner crucible 10 inside a protection crucible 20. A cryolite bath 30 is contained in the inner crucible 10, and a cathode 40 is provided in the bath 30. An inert anode 50 is positioned in the bath 30. An alumina feed tube 60 extends partially into the inner crucible 10 above the bath 30. The cathode 40 and inert anode 50 are separated by a distance 70 known as the anode-cathode distance (ACD). Aluminum 80 produced during a run is deposited on the cathode 40 and on the bottom of the crucible 10. In addition to the production of aluminum, the inert anodes of the invention may also be useful in producing metals such as lead, magnesium, zinc, zirconium, titanium, lithium, calcium, silicon and the like, by electrolytic reduction of an oxide or other salt of the metal.

As used herein, the term "inert anode" means a substantially nonconsumable anode, which possesses satisfactory corrosion resistance and stability during the aluminum production process. The term "commercial purity aluminum" as used herein means aluminum, which meets commercial purity standards upon production by an electrolytic reduction process. The commercial purity aluminum preferably comprises a maximum of 0.2 weight percent Fe, 0.1 weight percent Cu, and 0.034 weight percent Ni. In a more preferred embodiment, the commercial purity aluminum comprises a maximum of 0.15 weight percent Fe, 0.034 weight percent Cu, and 0.03 weight percent Ni. In a particularly preferred embodiment, the commercial purity aluminum comprises a maximum of 0.13 weight percent Fe, 0.03 weight percent Cu, and 0.03 weight percent Ni. The commercial purity aluminum also preferably meets the following weight percentage standards for other types of impurities: 0.2 maximum Si; 0.03 maximum Zn; and 0.034 maximum Co. The Si impurity level is more preferably kept below 0.15 or 0.10 weight percent and the Co level is more preferably kept below 0.03 weight percent. It is noted that for every numerical range or limit set forth herein, all numbers with the range or limit including every fraction or decimal between its stated minimum and/or maximum, are considered to be designated and disclosed by this description.

Inert anodes of the present invention have at least one ceramic phase, and in a preferred embodiment also have at least one metal phase. For cermets, the ceramic phase typically comprises at least 50 weight percent of the cermet, preferably from about 70 to about 90 weight percent of the cermet. At least a portion of the anode may comprise up to 100 percent of the ceramic phase. In one embodiment, the anode may comprise a cermet or metal coated or covered with the ceramic phase. In this embodiment, the outer ceramic layer preferably has a thickness of from 0.1 to 50 mm, more preferably from 0.2 to 5 mm.

The ceramic phase preferably comprises nickel, iron and cobalt oxide, and is of the formula $Ni_xFe_{2y}Co_zO_{(3y+x+z)\pm\delta}$. In the foregoing formula, the oxygen stoichiometry is not necessarily equal to 3y+x+z, but may change slightly up or down depending upon firing conditions by a factor of δ. The value of δ may range from 0 to 0.3, preferably from 0 to 0.2.

In the present compositions, the mole fraction of NiO typically ranges from 0.15 to 0.99, the mole fraction of $Fe_2O_3$ typically ranges from 0.0001 to 0.85, and the mole fraction of CoO typically ranges from 0.0001 to 0.45. In the preferred compositions, the mole fraction of NiO ranges from 0.15 to 0.6, the mole fraction of $Fe_2O_3$ ranges from 0.4 to 0.6, and the mole fraction of CoO ranges from 0.001 to 0.25. In the more preferred compositions, the mole fraction of NiO ranges from 0.25 to 0.55, the mole fraction of $Fe_2O_3$ ranges from 0.45 to 0.55, and the mole fraction of CoO ranges from 0.001 to 0.2. Table 1 lists the typical, preferred and more preferred mole faction ranges of NiO, $Fe_2O_3$ and CoO. The listed mole fractions may be multiplied by 100 to indicate mole percentages. Within these ranges, the solubility of the constituent oxides in an electrolyte bath is reduced significantly. Lower oxide solubility is believed to improve the purity of the aluminum produced in the bath.

TABLE 1

Mole Fractions of NiO, $Fe_2O_3$ and CoO

| | NiO | $Fe_2O_3$ | CoO |
|---|---|---|---|
| Typical | 0.15–0.99 | 0.0001–0.85 | 0.0001–0.45 |
| Preferred | 0.15–0.6 | 0.4–0.6 | 0.001–0.25 |
| More Preferred | 0.25–0.55 | 0.45–0.55 | 0.001–0.2 |

Figure 2:
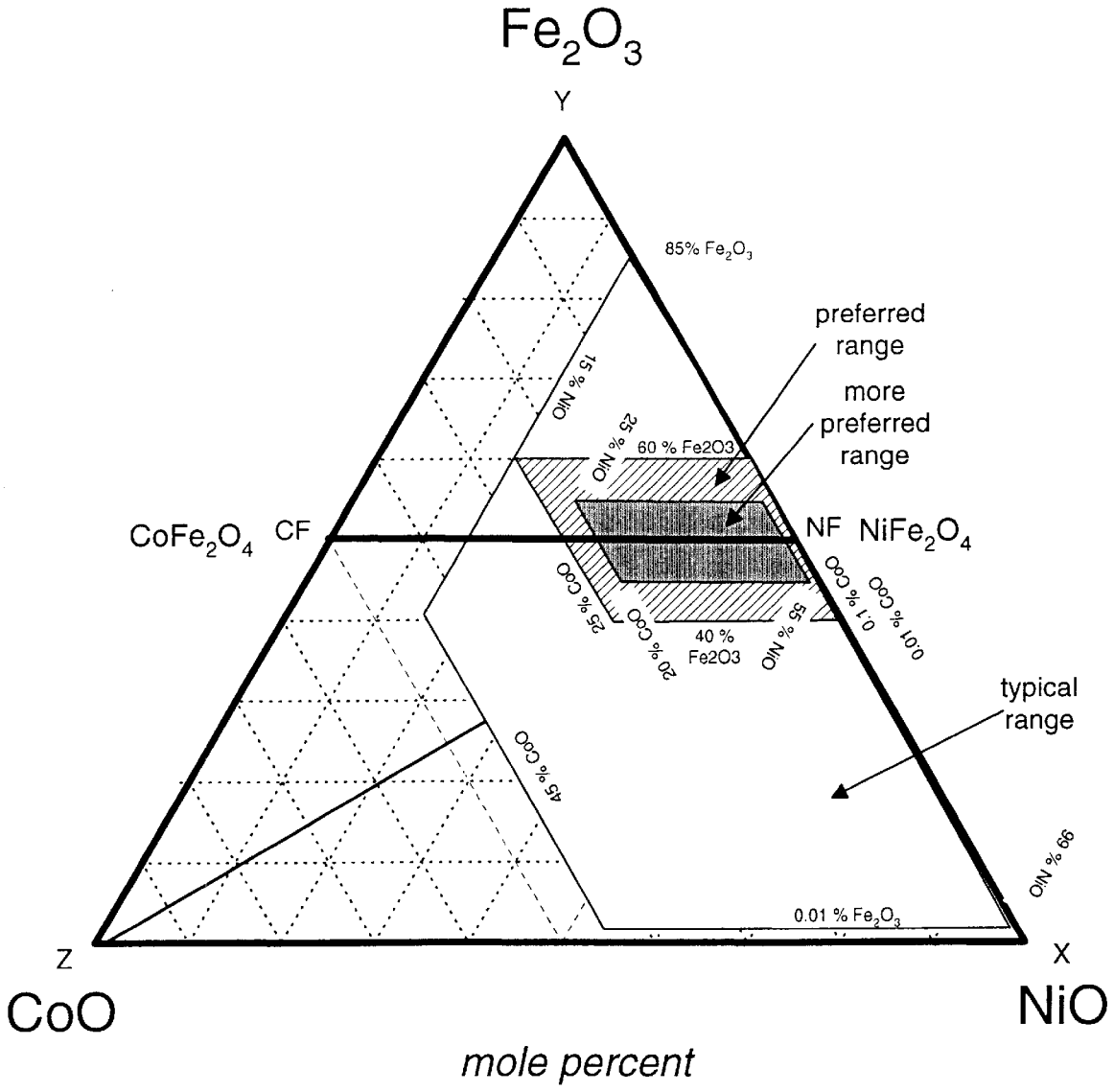
FIG. 2 is a ternary phase diagram illustrating compositional ranges of nickel, iron and cobalt oxides utilized in inert anode compositions of the present invention.

FIG. 2 is a ternary phase diagram illustrating typical, preferred and more preferred ranges of NiO, $Fe_2O_3$ and CoO starting materials used to make inert anode compositions in accordance with embodiments of the present invention. Although the mole percentages illustrated in FIG. 2 are based on NiO, $Fe_2O_3$ and CoO starting materials, other iron, nickel and zinc oxides, or compounds which form oxides upon calcination, may be used as starting materials in accordance with the present invention.

Table 2 lists some Ni—Fe—Co—O materials that may be suitable as the ceramic phase of the present inert anodes, as well as Co—Fe—O and Ni—Fe—O comparison materials. In addition to the phases listed in Table 2, minor or trace amounts of other phases may be present.

TABLE 2

Ni—Fe—Co—O Compositions

| Sample I.D. | Nominal Composition | Measured Elemental Weight Percent Fe, Ni, Co | Structural Types (identified by XRD) |
|---|---|---|---|
| CF | $CoFe_2O_4$ | 44, 0.17, 24 | $CoFe_2O_4$ |
| NCF1 | $Ni_{0.5}Co_{0.5}Fe_2O_4$ | 44, 12, 11 | $NiFe_2O_4$ |
| NCF2 | $Ni_{0.7}Co_{0.3}Fe_2O_4$ | 45, 16, 7.6 | $NiFe_2O_4$ |
| NCF3 | $Ni_{0.7}Co_{0.3}Fe_{1.95}O_4$ | 42, 18, 6.9 | $NiFe_2O_4$ |
| NCF4 | $Ni_{0.85}Co_{0.15}Fe_{1.95}O_4$ | 44, 20, 3.4 | $NiFe_2O_4$ |
| NCF5 | $Ni_{0.80}Co_{0.3}Fe_{1.9}O_4$ | 45, 20, 7.0 | $NiFe_2O_4$, NiO |
| NF | $NiFe_2O_4$ | 48, 23, 0 | N/A |

Figure 3:
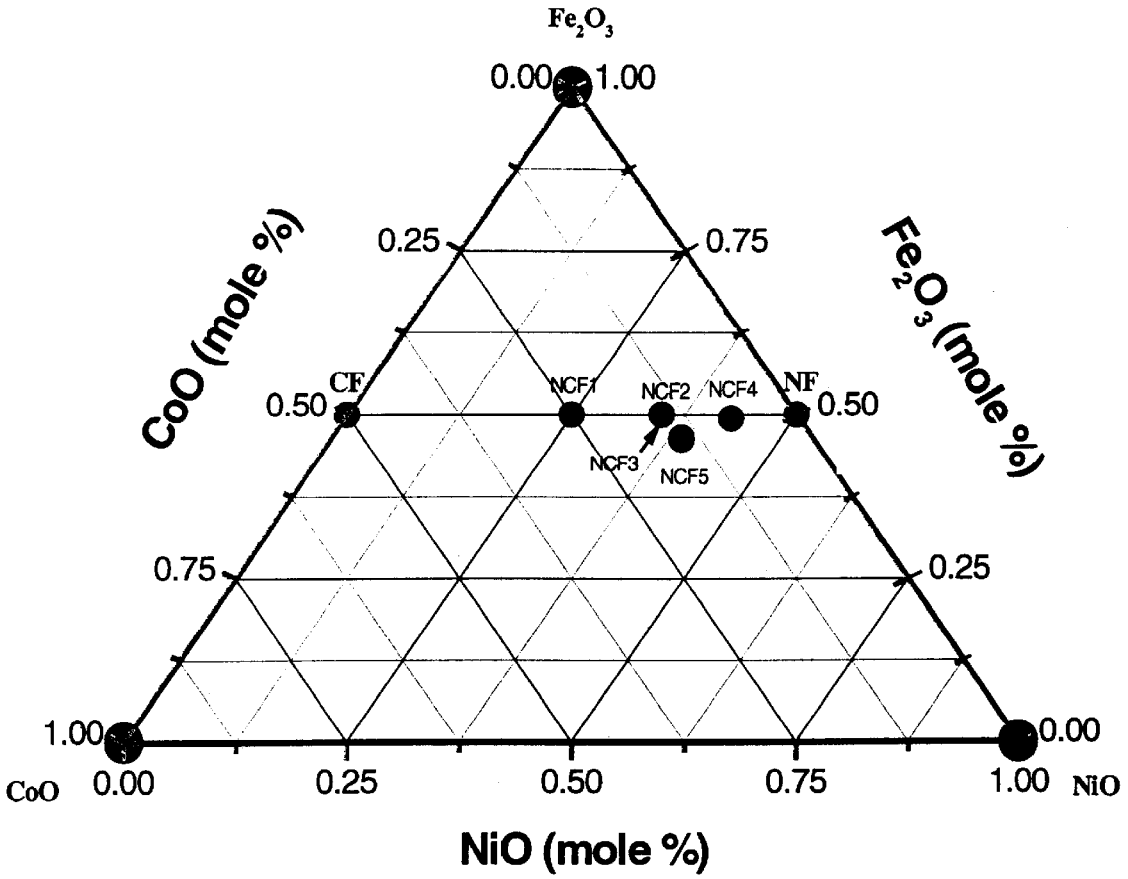
FIG. 3 is a ternary phase diagram illustrating the amounts of nickel, iron and cobalt oxides utilized in specific inert anode compositions in accordance with embodiments of the present invention.

FIG. 3 is a ternary phase diagram illustrating the amounts of NiO, $Fe_2O_3$ and CoO starting materials used to make the compositions listed in Table 2, which may be used alone or as the ceramic phase(s) of cermet inert anodes. Such inert anodes may in turn be used to produce commercial purity aluminum in accordance with the present invention.

The oxide compositions listed in Table 2 and shown in FIG. 3 may be prepared and tested as follows. Oxide powders are synthesized by a wet chemical approach. The starting chemicals include one or a mixture of chlorides, acetates, nitrates, tartarates, citrates and sulfates of Ni, Fe and Co salts. Chlorides, acetates and nitrates of Ni, Fe and Co salts are preferred precursors. Such precursors are commercially available from sources such as Aldrich and Fisher. A homogeneous solution is prepared by dissolving the desired amounts of the chemicals into de-ionized water. The solution pH is adjusted to 6–9 by adding ammonium hydroxide while stirring. A pH of from 7 to 8 is preferred. The viscous solution is dried by oven, freeze dryer, spray dryer or the like. The resultant dried solid is amorphous. Crystalline oxide powders are obtained after calcination of the dried solid, e.g., at a temperature of from 600 to 800° C. for 2 hours. The oxide powders are then uniaxially or isostatically pressed to pellet form under a pressure of from 10,000 to 30,000 psi, typically 20,000 psi. The pressed pellets are sintered in air at a temperature of 1,000–1500° C., typically 1350° C., for 2–4 hours. The crystalline structure and the composition of the sintered oxide pellets may be analyzed by x-ray diffraction (XRD) and inductively-coupled plasma (ICP) techniques.

The solubilities of the Ni—Fe—Co—O anode compositions of the invention were tested by holding approximately 3 g of sintered oxide pellets in 160 g of a standard cryolitic molten salt bath at 960° C. for 96 hours. The standard salt bath was contained in a platinum crucible and prepared by batching NaF, $AlF_3$, Greenland cryolite, $CaF_2$ and $Al_2O_3$ so that NaF:$AlF_3$=1.1, $Al_2O_3$=5 weight percent, and $CaF_2$=5 weight percent. Dried air was circulated over the salt bath at a low flow rate of 100 $cm^3$/min, as well as periodically bubbled into the molten salt to maintain oxidizing conditions. Samples of the melt were withdrawn periodically for chemical analysis. When the foregoing solubility test method is used, the weight percentage of total dissolved oxides is preferably below 0.1 weight percent, more preferably below 0.08 weight percent. The amount of total dissolved oxides, i.e., $Fe_2O_3$, NiO and $Co_3O_4$, as measured by the foregoing procedure, is defined herein as the "Hall cell bath solubility". The Hall cell bath solubility of the present compositions is preferably below the solubility of stoichiometric nickel ferrite.

Table 3 lists the Hall cell bath solubilities for Ni—Fe—Co—O materials of the present invention in comparison with solubilites for nickel ferrite and cobalt ferrite compositions. The solubility values listed in Table 3 were measured after bath saturation. The total dissolved oxide content of each bath is the sum of the oxide saturation values, with a low total dissolved oxide content being desirable.

TABLE 3

Oxide Solubilities

| | | Bath Saturation (weight percent) | | | |
|---|---|---|---|---|---|
| Sample I.D. | Nominal Composition | NiO | $Fe_2O_3$ | $Co_3O_4$ | Total |
| CF | $CoFe_2O_4$ | 0.003 | 0.110 | 0.055 | 0.168 |
| NCF1 | $Ni_{0.5}Co_{0.5}Fe_2O_4$ | 0.005 | 0.089 | 0.026 | 0.120 |
| NCF3 | $Ni_{0.7}Co_{0.3}Fe_{1.95}O_4$ | 0.006 | 0.040 | 0.007 | 0.053 |
| NCF4 | $Ni_{0.85}Co_{0.15}Fe_{1.95}O_4$ | 0.011 | 0.056 | 0.006 | 0.073 |
| NCF5 | $Ni_{0.8}Co_{0.3}Fe_{1.9}O_4$ | 0.006 | 0.086 | 0.017 | 0.109 |
| NF | $NiFe_2O_4$ | 0.011 | 0.074 | <0.001 | 0.085 |
| NF | $NiFe_2O_4$ | 0.010 | 0.090 | <0.001 | 0.10 |

Figure 4:
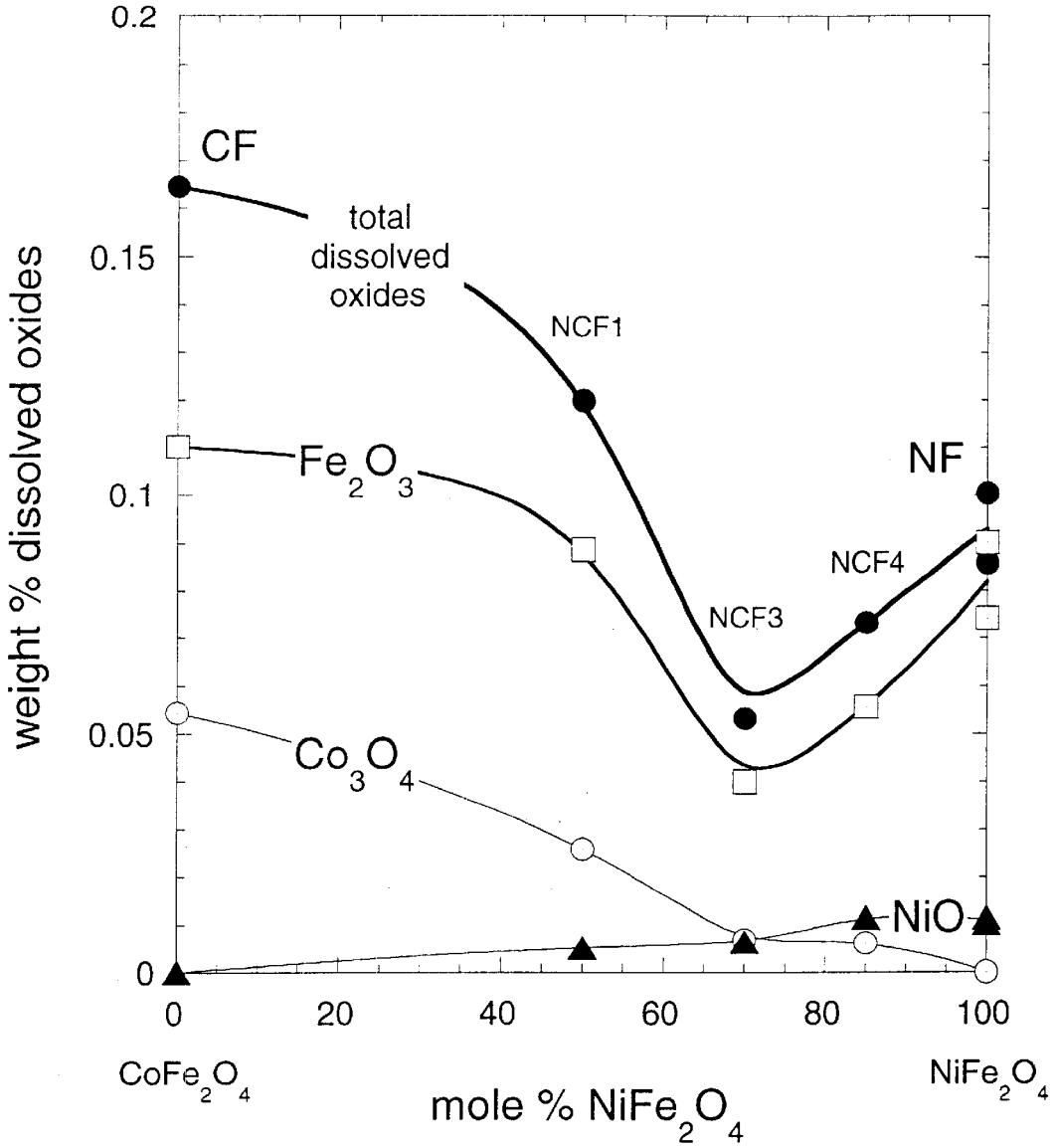
FIG. 4 is a graph showing examples of the weight percentages of dissolved iron, cobalt and nickel oxides in a salt bath typically used in an aluminum production cell after anode compositions containing nickel oxide, iron oxide and varying amounts of cobalt oxide have been exposed to the salt bath.

FIG. 4 shows the Fe, Co and Ni oxide solubility levels listed in Table 3. The compositions of the present invention listed in Table 3 and shown in FIG. 4 exhibit very low oxide dissolution values, particularly for compositions NCF3 and NCF4 which possess Hall cell bath solubilities of less than 0.08 weight percent total dissolved oxides.

In an embodiment of the invention, in addition to the Ni—Fe—Co—O ceramic phase(s), the inert anodes of the present invention may include at least one metal phase. The metal phase may include, for example, a base metal and at least one noble metal. Copper and silver are preferred base metals. However, other electrically conductive metals may optionally be used to replace all or part of the copper or silver. Furthermore, additional metals such as Co, Ni, Fe, Al, Sn, Nb, Ta, Cr, Mo, W and the like may be alloyed with the base metal. Such base metals may be provided from individual or alloyed powders of the metals, or as oxides of such metals.

The noble metal preferably comprises at least one metal selected from Ag, Pd, Pt, Au, Rh, Ru, Ir and Os. More preferably, the noble metal comprises Ag, Pd, Pt, Ag and/or Rh. Most preferably, the noble metal comprises Ag, Pd or a combination thereof. The noble metal may be provided from individual or alloyed powders of the metals, or as oxides of such metals, e.g., silver oxide, palladium oxide, etc.

Preferably, metal phase(s) of the inert electrode comprises at least about 60 weight percent of the combined base metal and noble metal, more preferably at least about 80 weight percent. The presence of base metal/noble metal provides high levels of electrical conductivity through the inert electrodes. The base metal/noble metal phase may form either a continuous phase(s) within the inert electrode or a discontinuous phase(s) separated by the oxide phase(s).

The metal phase of the inert electrode typically comprises from about 50 to about 99.99 weight percent of the base metal, and from about 0.01 to about 50 weight percent of the noble metal(s). Preferably, the metal phase comprises from about 70 to about 99.95 weight percent of the base metal, and from about 0.05 to about 30 weight percent of the noble metal(s). More preferably, the metal phase comprises from about 90 to about 99.9 weight percent of the base metal, and from about 0.1 to about 10 weight percent of the noble metal(s).

The types and amounts of base and noble metals contained in the metal phase of the inert anode are selected in order to substantially prevent unwanted corrosion, dissolution or reaction of the inert electrodes, and to withstand the high temperatures which the inert electrodes are subjected to during the electrolytic metal reduction process. For example, in the electrolytic production of aluminum, the production cell typically operates at sustained smelting temperatures above 800° C., usually at temperatures of 900–980° C. Accordingly, inert anodes used in such cells should preferably have melting points above 800° C., more preferably above 900° C., and optimally above about 1,000° C.

In one embodiment of the invention, the metal phase comprises copper as the base metal and a relatively small amount of silver as the noble metal. In this embodiment, the silver content is preferably less than about 10 weight percent, more preferably from about 0.2 to about 9 weight percent, and optimally from about 0.5 to about 8 weight percent, remainder copper. By combining such relatively small amounts of Ag with such relatively large amounts of Cu, the melting point of the Cu—Ag alloy phase is significantly increased relative to the eutectic point. For example, an alloy comprising 95 weight percent Cu and 5 weight percent Ag has a melting point of approximately 1,000° C., while an alloy comprising 90 weight percent Cu and 10 weight percent Ag forms a eutectic having a melting point of approximately 780° C. This difference in melting points is particularly significant where the alloys are to be used as part of inert anodes in electrolytic aluminum reduction cells, which typically operate at smelting temperatures of greater than 800° C.

In another embodiment of the invention, the metal phase comprises copper as the base metal and a relatively small amount of palladium as the noble metal. In this embodiment, the Pd content is preferably less than about 20 weight percent, more preferably from about 0.1 to about 10 weight percent.

In a further embodiment of the invention, the metal phase comprises silver as the base metal and a relatively small amount of palladium as the noble metal. In this embodiment, the Pd content is preferably less than about 50 weight percent, more preferably from about 0.05 to about 30 weight percent, and optimally from about 0.1 to about 20 weight percent. Alternatively, silver may be used alone as the metal phase of the anode.

In another embodiment of the invention, the metal phase comprises Cu, Ag and Pd. In this embodiment, the amounts of Cu, Ag and Pd are preferably selected in order to provide an alloy having a melting point above 800° C., more preferably above 900° C., and optimally above about 1,000° C. The silver content is preferably from about 0.5 to about 30 weight percent of the metal phase, while the Pd content is preferably from about 0.01 to about 10 weight percent. More preferably, the Ag content is from about 1 to about 20 weight percent of the metal phase, and the Pd content is from about 0.1 to about 10 weight percent. The weight ratio of Ag to Pd is preferably from about 2:1 to about 100:1, more preferably from about 5:1 to about 20:1.

In accordance with a preferred embodiment of the present invention, the types and amounts of base and noble metals contained in the metal phase are selected such that the resultant material forms at least one alloy phase having an increased melting point above the eutectic melting point of the particular alloy system. For example, as discussed above in connection with the binary Cu—Ag alloy system, the amount of the Ag addition may be controlled in order to substantially increase the melting point above the eutectic melting point of the Cu—Ag alloy. Other noble metals, such as Pd and the like, may be added to the binary Cu—Ag alloy system in controlled amounts in order to produce alloys having melting points above the eutectic melting points of the alloy systems. Thus, binary, ternary, quaternary, etc. alloys may be produced in accordance with the present invention having sufficiently high melting points for use as part of inert electrodes in electrolytic metal production cells.

The inert anodes may be formed by techniques such as powder sintering, sol-gel processing, slip casting and spray forming. Preferably, the inert anodes are formed by powder techniques in which powders comprising the oxides and optional metals are pressed and sintered. The inert anode may comprise a monolithic component of such materials, or may comprise a substrate having at least one coating or layer of such material.

Prior to combining the ceramic and metal powders, the ceramic powders, such as NiO, $Fe_2O_3$ and CoO, may be blended in a mixer. Optionally, the blended ceramic powders may be ground to a smaller size before being transferred to a furnace where they are calcined, e.g., for 12 hours at 1,250° C. The calcination produces a mixture made from oxide phases, for example, as illustrated in FIGS. 2 and 3. As an alternative to the use of mixed metal oxides as the starting materials, the oxide powder may be formed by wet chemical methods utilizing precursors of the constituent oxides. If desired, the mixture may include other oxide powders and/or oxide-forming metal powders such as Al. Additional oxide powders may include oxides of metals from Groups IIA to VA and IB to VIIIB of the Periodic Table, as well as rare earth metals and the like. For example, $Co_3O_4$, $Cr_2O_3$ and/or ZnO may be used as the additional oxides.

The calcined oxide mixture may be ground to an average particle size of approximately 10 microns, e.g., in a ball mill. The fine oxide particles are blended with a polymeric binder and water to make a slurry. The slurry may contain about 60 weight percent solids and about 40 weight percent water. Spray drying the slurry produces dry agglomerates of the oxides that may be transferred to a V-blender and optionally mixed with metal powders. The metal powders may comprise substantially pure metals and alloys thereof, or may comprise oxides of a base metal and/or a noble metal.

In a preferred embodiment, about 1–10 parts by weight of an organic polymeric binder are added to 100 parts by weight of the metal oxide and optional metal particles. Some suitable binders include polyvinyl alcohol, acrylic polymers, polyglycols, polyvinyl acetate, polyisobutylene, polycarbonates, polystyrene, polyacrylates, and mixtures and copolymers thereof. Preferably, about 3–6 parts by weight of the binder are added to 100 parts by weight of the oxide and metal mixture.

The V-blended mixture of oxide and optional metal powders may be sent to a press where it is isostatically pressed, for example at 10,000 to 40,000 psi, into anode shapes. A pressure of about 20,000 psi is particularly suitable for many applications. The pressed shapes may be sintered in a controlled atmosphere furnace supplied with an argon-oxygen gas mixture. Sintering temperatures of 1,000–1,400° C. may be suitable. The furnace is typically operated at 1,350–1,385° C. for 2–4 hours. The sintering process barns out any polymeric binder from the anode shapes.

The gas supplied during sintering preferably contains about 5–3,000 ppm oxygen, more preferably about 5–700 ppm and most preferably about 10–350 ppm. Lesser concentrations of oxygen result in a product having a larger metal phase than desired, and excessive oxygen results in a product having too much of the phase containing metal oxides (ceramic phase). The remainder of the gaseous atmosphere preferably comprises a gas such as argon that is inert to the metal at the reaction temperature.

Sintering anode compositions in an atmosphere of controlled oxygen content typically lowers the porosity to acceptable levels and avoids bleed out of any metal phase. The atmosphere may be predominantly argon, with controlled oxygen contents in the range of 17 to 350 ppm. Anode compositions sintered under these conditions typically have less than 0.5 percent porosity when the compositions are sintered in argon containing 70–150 ppm oxygen.

The sintered anode may be connected to a suitable electrically conductive support member within an electrolytic metal production cell by means such as welding, diffusion welding, brazing, mechanically fastening, cementing and the like.

The inert anode may include a ceramic as described above successively connected in series to a cermet transition region and a nickel end. A nickel or nickel-chromium alloy rod may be welded to the nickel end. The transition region, for example, may include four layers of graded composition, ranging from 25 weight percent Ni adjacent the ceramic or cermet end and then 50, 75 and 100 weight percent Ni, balance the mixture of oxide and optional metal powders described above.

Inert anodes are particularly useful in electrolytic cells for aluminum production operated at temperatures in the range of about 800–1,000° C. A particularly preferred cell operates at a temperature of about 900–980° C., preferably about 930–970° C. An electric current is passed between the inert anode and a cathode through a molten salt bath comprising an electrolyte and an oxide of the metal to be collected. In a preferred cell for aluminum production, the electrolyte comprises aluminum fluoride and sodium fluoride and the metal oxide is alumina. The weight ratio of sodium fluoride to aluminum fluoride is about 0.7 to 1.25, preferably about 1.0 to 1.20. The electrolyte may also contain calcium fluoride, lithium fluoride and/or magnesium fluoride.

While the invention has been described in terms of preferred embodiments, various changes, additions and modifications may be made without departing from the scope of the invention as set forth in the following claims.

What is claimed is:

1. An inert anode composition for use in a molten salt bath, the composition comprising nickel, iron and cobalt oxide, wherein the amounts of nickel, iron and cobalt in the composition correspond to the following mole fractions of NiO, $Fe_2O_3$ and ZnO: 0.25 to 0.55 NiO; 0.45 to 0.55 $Fe_2O_3$; and 0.001 to 0.2 CoO.

2. The inert anode composition of claim 1, wherein the mole fraction of NiO is about 0.35, the mole fraction of $Fe_2O_3$ is about 0.5, and the mole fraction of CoO is about 0.15.

3. The inert anode composition of claim 1, wherein the composition comprises the nominal formula $Ni_{0.7}Co_{0.3}Fe_2O_4$.

4. The inert anode composition of claim 1, wherein the composition comprises the nominal formula $Ni_{0.7}Co_{0.3}Fe_{1.95}O_4$.

5. The inert anode composition of claim 1, wherein the composition comprises the nominal formula $Ni_{0.85}Co_{0.15}Fe_{1.95}O_4$.

6. The inert anode composition of claim 1, wherein the composition comprises the nominal formula $Ni_{0.8}Co_{0.3}Fe_{1.9}O_4$.

7. The inert anode composition of claim 1, wherein the composition is made from NiO, $Fe_2O_3$ and CoO, or precursors thereof.

8. The inert anode composition of claim 1, wherein the composition further comprises at least one metal selected from Cu, Ag, Pd, Pt, Au, Rh, Ru, Ir and Os.

9. The inert anode composition of claim 8, wherein at the least one metal is selected from Cu, Ag, Pd and Pt and combinations thereof.

10. The inert anode composition of claim 1, wherein the composition has a Hall cell bath solubility of less than 0.1 weight percent total dissolved oxides.

11. The inert anode composition of claim 1, wherein the composition has a Hall cell bath solubility of less than 0.08 weight percent total dissolved oxides.

12. A method of making an inert anode composition, the method comprising:

mixing nickel oxide, iron oxide and cobalt oxide or precursors thereof; and calcining the mixture to form a ceramic material comprising nickel, iron and cobalt oxide, wherein the amounts of nickel, iron and cobalt in the composition correspond to the following mole fractions of NiO, $Fe_2O_3$ and ZnO: 0.25 to 0.55 NiO; 0.45 to 0.55 $Fe_2O_3$; and 0.001 to 0.2 CoO.

13. The method of claim 12, wherein the ceramic material comprises the nominal formula $Ni_{0.7}Co_{0.3}Fe_2O_4$.

14. The method of claim 12, wherein the ceramic material comprises the nominal formula $Ni_{0.7}Co_{0.3}Fe_{1.95}O_4$.

15. The method of claim 12, wherein the ceramic material comprises the nominal formula $Ni_{0.85}Co_{0.15}Fe_{1.95}O_4$.

16. The method of claim 12, wherein the ceramic material comprises the nominal formula $Ni_{0.8}Co_{0.3}Fe_{1.9}O_4$.

17. The method of claim 12, wherein the composition is made from NiO, $Fe_2O_3$ and ZnO starting materials.

18. The method of claim 12, wherein the composition is made from at least one precursor compound selected from the group comprising chlorides, acetates, nitrates, tartarates, citrates and sulfates of Ni, Fe and Co salts.

19. An electrolytic cell for producing metal comprising:

a molten salt bath comprising an electrolyte and an oxide of a metal to be collected;

a cathode; and an inert anode comprising nickel, iron and cobalt oxide, wherein the amounts of nickel, iron and cobalt in the composition correspond to the following mole fractions of NiO, $Fe_2O_3$ and ZnO: 0.25 to 0.55 NiO; 0.45 to 0.55 $Fe_2O_3$; and 0.001 to 0.2 CoO.

20. The electrolytic cell of claim 19, wherein the mole fraction of NiO is about 0.35, the mole fraction of $Fe_2O_3$ is about 0.5, and the mole fraction of CoO is about 0.15.

21. The electrolytic cell of claim 19, wherein the inert anode comprises the nominal formula $Ni_{0.7}Co_{0.3}Fe_2O_4$.

22. The electrolytic cell of claim 19, wherein the inert anode comprises the nominal formula $Ni_{0.7}Co_{0.3}Fe_{1.95}O_4$.

23. The electrolytic cell of claim 19, wherein the inert anode comprises the nominal formula $Ni_{0.85}Co_{0.15}Fe_{1.95}O_4$.

24. The electrolytic cell of claim 19, wherein the inert anode comprises the nominal formula $Ni_{0.80}Co_{0.3}Fe_{1.9}O_4$.

25. A method of producing commercial purity aluminum comprising:

passing current between an inert anode and a cathode through a bath comprising an electrolyte and aluminum oxide; and recovering aluminum comprising a maximum of 0.20 weight percent Fe, 0.1 weight percent Cu, and 0.034 weight percent Ni, wherein the inert anode comprises nickel, iron and cobalt oxide, and the amounts of nickel, iron and cobalt in the composition correspond to the following mole fractions of NiO, $Fe_2O_3$ and ZnO: 0.25 to 0.55 NiO; 0.45 to 0.55 $Fe_2O_3$; and 0.001 to 0.2 CoO.

26. The method of claim 25, wherein the mole fraction of NiO is about 0.35, the mole fraction of $Fe_2O_3$ is about 0.5, and the mole fraction of CoO is about 0.15.

27. The method of claim 25, wherein the inert anode comprises the nominal formula $Ni_{0.7}Co_{0.3}Fe_2O_4$.

28. The method of claim 25, wherein the inert anode comprises the nominal formula $Ni_{0.7}Co_{0.3}Fe_{1.95}O_4$.

29. The method of claim 25, wherein the inert anode comprises the nominal formula $Ni_{0.85}Co_{0.15}Fe_{1.95}O_4$.

30. The method of claim 25, wherein the inert anode comprises the nominal formula $Ni_{0.80}Co_{0.3}Fe_{1.9}O_4$.

31. The method of claim 25, wherein the recovered aluminum comprises a maximum of 0.15 weight percent Fe, 0.034 weight percent Cu, and 0.03 weight percent Ni.

32. The method of claim 25, wherein the recovered aluminum comprises a maximum of 0.13 weight percent Fe, 0.03 weight percent Cu, and 0.03 weight percent Ni.

33. The method of claim 25, wherein the recovered aluminum further comprises a maximum of 0.2 weight percent Si, 0.034 weight percent Zn, and 0.03 weight percent Co.

34. The method of claim 25, wherein the recovered aluminum comprises a maximum of 0.10 weight percent of the total of the Cu, Ni and Co.

35. The method of claim 25, wherein the nickel, iron and cobalt oxide has a Hall cell bath solubility of less than 0.1 weight percent total dissolved oxides.

36. The method of claim 25, wherein the nickel, iron and cobalt oxide has a Hall cell bath solubility of less than 0.08 weight percent total dissolved oxides.

* * * * *